US005080173A

United States Patent [19]

Brammer

[11] Patent Number: 5,080,173

[45] Date of Patent: Jan. 14, 1992

[54] TIEBACK WELLHEAD SYSTEM WITH SIDETRACK FACILITIES

[75] Inventor: Norman Brammer, Belvidere House Fyvie Turiff, Scotland

[73] Assignee: ABB Vetco Gray Inc., Houston, Tex.

[21] Appl. No.: 647,770

[22] Filed: Jan. 30, 1991

[51] Int. Cl.[5] ..... E21B 23/00; E21B 33/043

[52] U.S. Cl. ..... 166/348; 166/382; 166/208; 285/141; 285/143

[58] Field of Search ..... 166/339, 341, 348, 382, 166/387, 208; 285/140, 141, 142, 143, 18

[56] References Cited

U.S. PATENT DOCUMENTS

| | | | |
|---|---|---|---|
| 3,468,558 | 9/1967 | Ahlstone . | |
| 3,492,026 | 1/1970 | Ahlstone . | |
| 4,093,030 | 6/1978 | Bonds | 166/382 |
| 4,540,053 | 9/1985 | Baugh et al. . | |
| 4,577,686 | 3/1986 | Milberger et al. | 166/208 |
| 4,595,053 | 6/1986 | Watkins et al. | 166/382 |
| 4,691,780 | 9/1987 | Galle, Jr. et al. | 166/348 |
| 4,880,061 | 11/1989 | Ahlstone . | |
| 4,976,458 | 12/1990 | Hosie et al. | 166/348 |

OTHER PUBLICATIONS

Combustion Engineering, Vetco Offshore Production Equipment, pp. 814–815.

*Primary Examiner*—Bruce M. Kisliuk
*Attorney, Agent, or Firm*—James E. Bradley

[57] ABSTRACT

A subsea well has tieback facilities for further sidetrack drilling. The well has an inner string casing hanger with an outer hanger portion and an inner hanger portion. The inner and outer hanger portions are latched together at the surface and lowered simultaneously. The inner casing string secures to the inner hanger portion. The tieback assembly includes an intermediate tieback conduit that extends into the bore of the outer hanger portion. An inner tieback conduit extend into the bore of the inner hanger portion. For later sidetrack drilling, the inner tieback conduit is pulled upward to unlatch the inner hanger portion from the outer hanger portion, retrieving the inner casing through the intermediate tieback conduit.

21 Claims, 4 Drawing Sheets

TIEBACK WELLHEAD SYSTEM WITH SIDETRACK FACILITIES

BACKGROUND OF THE INVENTION

1. Field of the Invention

This invention relates in general to subsea wellhead equipment, and in particular to a subsea wellhead system that utilizes a tieback to a production platform, and has the ability to remove the inner casing string without removing the intermediate and outer tieback conduits.

2. Description of the Prior Art

In a typical tieback system, a floating drilling rig will initially drill a few wells. These wells will be completed subsea, but initially will not have a production Christmas tree. Then, a platform will be positioned over the wells. Each subsea wellhead housing will be tied back to a production Christmas tree at the platform. The platform has production facilities and has a drilling rig for drilling subsequent wells.

Before tying back, the floating drilling rig will have installed two casing hangers in the subsea wellhead housing, each connected to a string of casing. The larger diameter casing, referred to herein as the intermediate casing, will be connected to the lower or intermediate string casing hanger. The intermediate casing hanger lands on a shoulder in the wellhead housing. A seal seals between the intermediate casing hanger and the bore of the wellhead housing.

The inner string casing hanger, which supports the inner string of casing, typically lands on the intermediate casing hanger. A seal seals the exterior of the inner string casing hanger to the bore of the wellhead housing at a point above the intermediate string casing hanger.

During the tieback procedure, an outer tieback conduit will be connected between the wellhead housing and the platform at the surface. One type connects the tieback conduit to exterior grooves on the wellhead housing, while another type connects to interior grooves. The interior connector type is less expensive than the exterior connector type, and is normally preferred. An intermediate string of casing will extend from the surface equipment on the platform into the bore of the intermediate string casing hanger. Subsequently, an inner string of casing will be lowered from surface equipment at the platform into the bore of the inner casing hanger and secured. Tubing will then be placed within the inner string for producing the well. The Christmas tree will be at the platform.

If the well production declines after a few years, the operator may wish to drill another well by sidetracking. In this procedure, the operator will cut the inner string above the level of cement and pull the inner string from the well. He will go back in with drilling equipment to sidetrack and drill a deviated well from the initial well at a point above the upper end of the remaining casing in the well. In this manner, the operator will be able to utilize the existing subsea wellhead housing, intermediate casing string, and intermediate casing hanger.

One problem in performing this task, however, is in retrieving the inner string of casing. If the tieback is of a type that connects the outer tieback conduit to the bore of the wellhead housing, then the inner string casing hanger cannot be pulled upward from the wellhead housing without first removing the outer tieback conduit. The intermediate string tieback conduit would also have to be removed. If the outer tieback conduit is of the type which connects to exterior grooves on the wellhead housing, all strings of tieback conduit except the outer string must be removed. Whether the outer tieback connector is interior or exterior, either procedure is time consuming, requires killing of the well and removal of the surface wellhead equipment.

SUMMARY OF THE INVENTION

In this invention, the inner casing hanger is of two parts that are separable from each other. The inner casing hanger includes an inner portion and an outer portion. The inner and outer portions will be latched together at the surface by a releasable latch. The inner portion supports the string of inner casing. The running tool for the inner casing string will connect to the outer portion.

The entire assembly will be lowered into place and landed on the intermediate casing hanger. A seal will seal between the outer hanger portion and the bore of the wellhead. Subsequently, a tieback assembly will be installed. The tieback assembly includes an outer tieback conduit that connects to the wellhead housing, and an intermediate tieback string that inserts into an upper section of the bore of the outer hanger portion. An inner tieback string extends into the bore of the inner hanger portion.

If sidetrack drilling is later desired, the operator will cut the inner string of casing at a point above the cement level. The operator will pull the inner tieback string upward. This causes the latch to release the inner hanger portion from the outer hanger portion. The inner hanger portion will move upward relative to the outer hanger portion, bringing along with it the string of inner casing above the cut.

The outer diameter of the inner hanger portion is less than the inner diameter of the intermediate tieback conduit. Consequently, the intermediate and outer tieback conduits can remain in place as the inner string is removed. This operation may be performed through the surface wellhead housing, with a blowout preventer in place and with full pressure control.

DETAILED DESCRIPTION OF THE INVENTION

Figure 1:
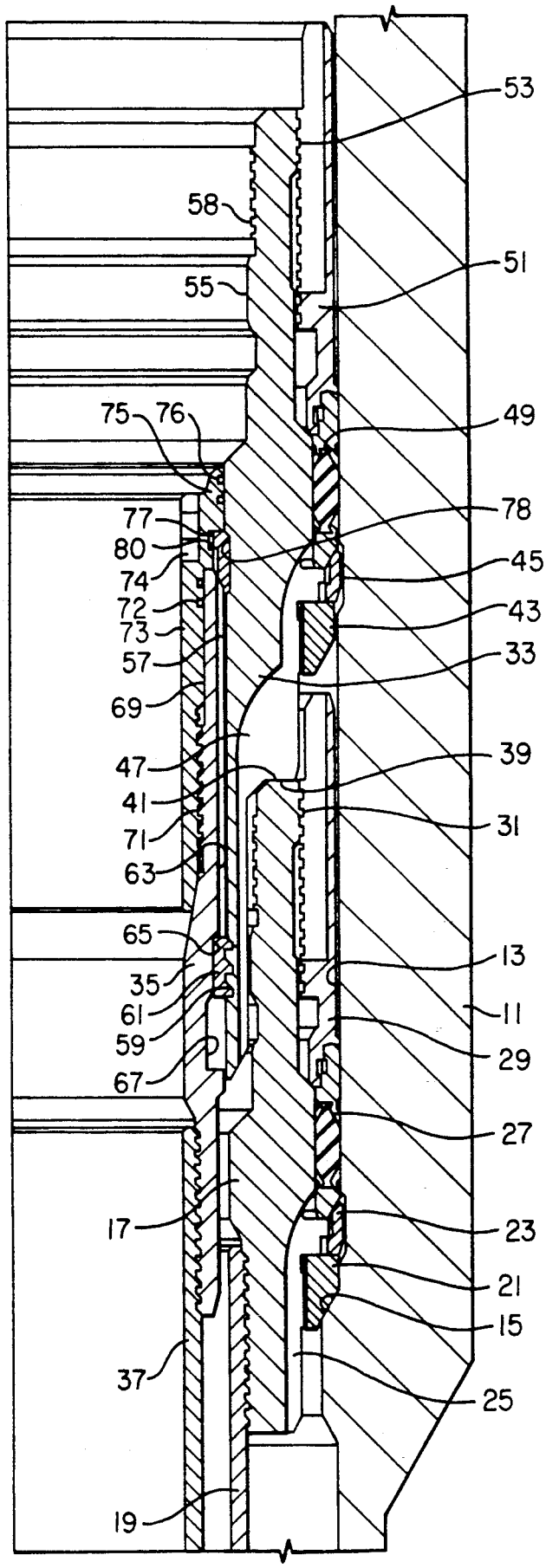
FIG. 1 is a quarter vertical sectional view of a portion of a subsea wellhead system constructed in accordance with this invention, and shown after drilling but before installation of a tieback assembly.

Referring to FIG. 1, wellhead housing 11 is a conventional tubular member that will be located on the sea floor. Wellhead housing 11 has a cylindrical bore 13 and an upward facing landing shoulder 15 located in bore 13. Large diameter conductor conduit (not shown) will be secured to the lower end of the wellhead housing 11 and will extend into the well for a selected depth.

An intermediate casing hanger 17 lands in bore 13. Intermediate casing hanger 17 is secured by threads to a string of intermediate casing 19. Intermediate casing 19 extends through the conductor conduit to a greater depth in the well and is cemented in place.

Intermediate string casing hanger 17 is conventional, having a support ring 21 which lands on the landing shoulder 15. A lock ring 23 will move outward into a recess provided in the bore 13 to lock intermediate casing hanger 17 to wellhead housing 11. A plurality of passages 25 on the exterior of intermediate casing hanger 17 allow fluid returns during cementing.

After cementing, a conventional packoff or seal 27 will be moved from an upper position (not shown) down to a lower position as shown in FIG. 1. Seal 27 will be set and retained by a retainer nut 29. Retainer nut 29 secures to threads 31 formed on the exterior upper end of the intermediate casing hanger 17.

An inner string casing hanger comprising an outer portion 33 and an inner portion 35 will be supported on the intermediate casing hanger 17. A string of inner casing 37 secures to the lower end of the inner hanger portion 35 by threads. The inner string 37 is typically $9\frac{5}{8}$ inch or $10\frac{3}{4}$ inch in diameter and will extend normally to the total depth of the well.

The outer hanger portion 33 has a downward facing shoulder 39 on its exterior that lands on the rim 41 of the intermediate casing hanger 17. A support ring 43 secures to the outer hanger portion 33. A lock ring 45 locates directly above the support ring 43. Lock ring 45 engages a recess in the bore 13 of wellhead housing 11 in a conventional manner. Fluid passages 47 allow the passage of cement returns during cementing. A packoff or seal 49 will be moved into the position shown in FIG. 1 and set after cementing. Seal 49 is conventional and is held by a retainer nut 51. Retainer nut 51 secures to threads 53 located on the exterior of the upper end of the outer hanger portion 33.

Outer hanger portion 33 has an upper bore section 55 and a lower bore section 57 of smaller diameter. Threads 58 are located at the upper end of upper bore section 55 for engagement by a conventional running tool (not shown). A set of internal, parallel grooves 59 are formed in the lower bore section 57 near the lower end of the outer hanger portion 33. The upper flanks of the grooves 59 are inclined. A split latch ring 61 will engage the internal grooves 59. Latch ring 61 has grooves or circumferential teeth on its exterior that mate with the grooves 59.

The inner hanger portion 35 has an exterior that is located entirely within the lower bore section 57 of the outer hanger portion 33. Vertical exterior channels 63 are located on the exterior of the inner hanger portion 35. An external groove 65 locates on the exterior of the inner hanger portion 35. Groove 65 is positioned adjacent internal grooves 59 when the inner hanger portion 35 is latched to the outer hanger portion 33 as shown.

The latch 61 will locate in both the external groove 65 and the internal grooves 59, retaining the inner and outer hanger portions 33, 35 together. There is also an anti-rotation pin (not shown) which locates in the split of the latch ring 61 and engages slots provided in the grooves 59, 65 to prevent rotation of the inner hanger portion 35 relative to the outer hanger portion 33.

A recess 67 joins the external grooves 65. Recess 67 is annular and extends downward from external groove 65. The diameter of recess 67 is less than the diameter of external groove 65. When the inner hanger portion 35 is pulled upward relative to the outer hanger portion 33, the recess 67 will locate radially inward from the latch ring 61. The latch ring 61 will contract into recess 67 due to its natural resiliency. This causes the teeth of the latch ring 61 to disengage from the grooves 59. This frees the inner hanger portion 35 from the outer hanger portion 33.

Inner hanger portion 35 has a bore 69. A set of threads 71 are formed in bore 69. A protective sleeve 73 will be installed in the bore 69 during drilling operations. Protective sleeve 73 secures to the threads 71. J-slots on the upper end of protective sleeve 73 enable the sleeve 73 to be pulled upward from the inner hanger portion 35. The upper end 75 of protective sleeve 73 is enlarged and has seals 76 for engaging the upper bore section 55 of the outer hanger portion 33. Seals 72 seal the protective sleeve 73 to the bore 69.

The seals 76 and 72 of the protective sleeve 73 serve to seal between the outer hanger portion 33 and the inner hanger portion 35 in order to seal the annulus. When the protective sleeve 73 is removed as shown in FIG. 2B, access to annulus pressure is provided by the channels 63 on the exterior of the inner hanger portion 35.

A lock ring 77 serves to prevent upward movement of the inner hanger portion 35 relative to the outer portion due to internal pressure. Lock ring 77 is a split ring that is wedged outward into a groove 78 in the outer hanger portion 33 during assembly of the protective sleeve 73. When in place, inner hanger portion 35 can not move upward relative to the outer hanger portion 33. A shoulder 80 on the exterior of protective sleeve 73 will engage a mating shoulder on the interior of lock ring 77. When the protective sleeve 73 is rotated and moved upward by a running tool engaging the J-slots 74, the shoulder 80 will pull the lock ring 77 upward. Lock ring 77 retracts from groove 78, allowing inner hanger portion 35 to be later removed from outer hanger portion 33.

Figure 2A:
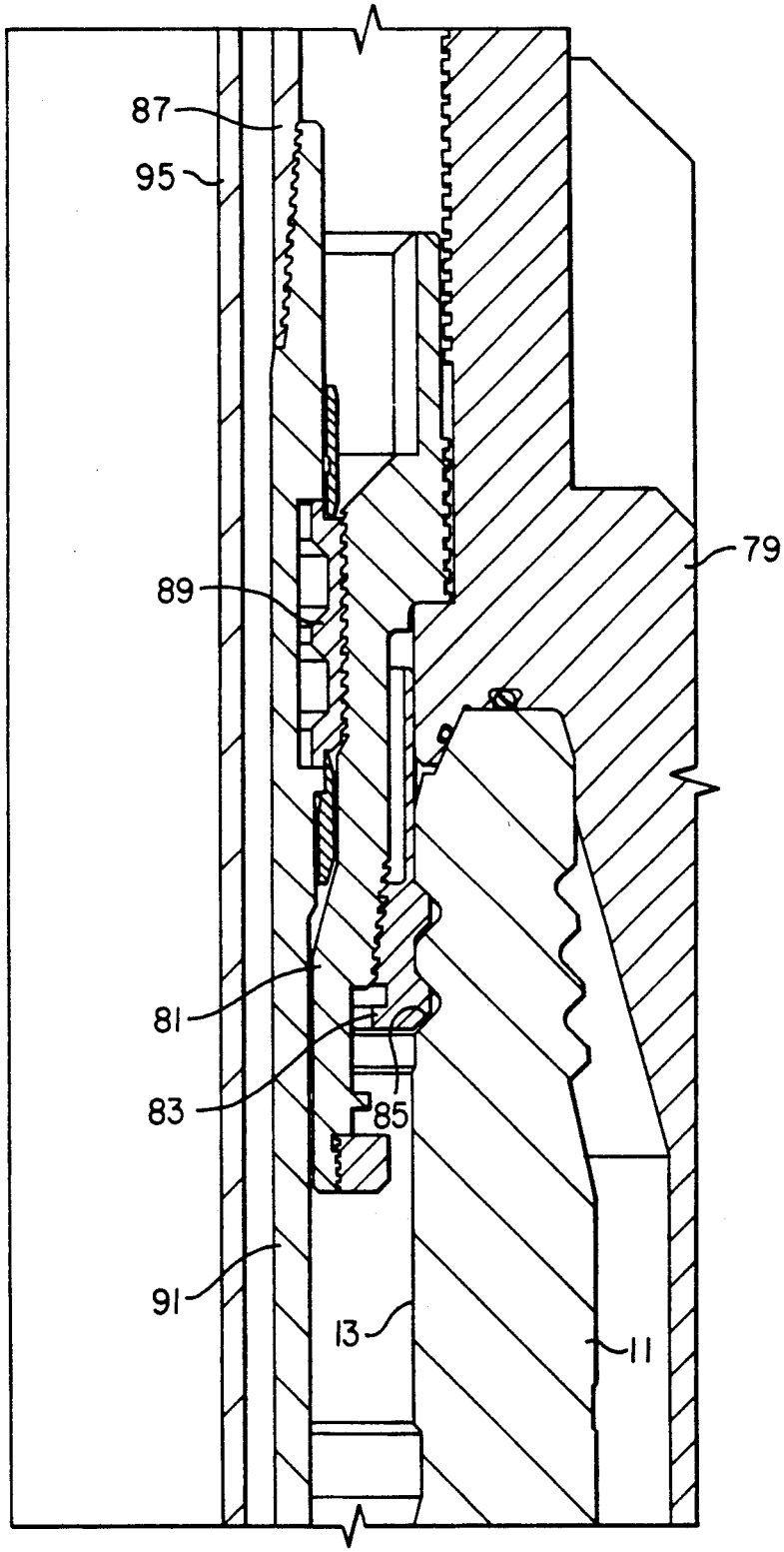
FIGS. 2A and 2B are vertical sectional views of the subsea wellhead of FIG. 1, showing a tieback assembly installed.

FIG. 1 illustrates the subsea wellhead system after drilling, but prior to installing tieback equipment. Referring to FIGS. 2A and 2B, the tieback equipment includes a guide funnel 79. Guide funnel 79 is secured to outer tieback conduit (not shown) that extends to a platform at the surface. Funnel 79 will land on the upper end of wellhead housing 11. The tieback assembly includes means for securing the funnel 79 to the wellhead housing 11. In the embodiment shown, this includes a torque nut 81 which acts against a latch 83. The latch 83 engages internal grooves 85 located in the interior of wellhead housing 11. This structure is described in more detail in U.S. Pat. No. 4,976,458, Dec. 11, 1990, Hosie et al.

Figure 2B:
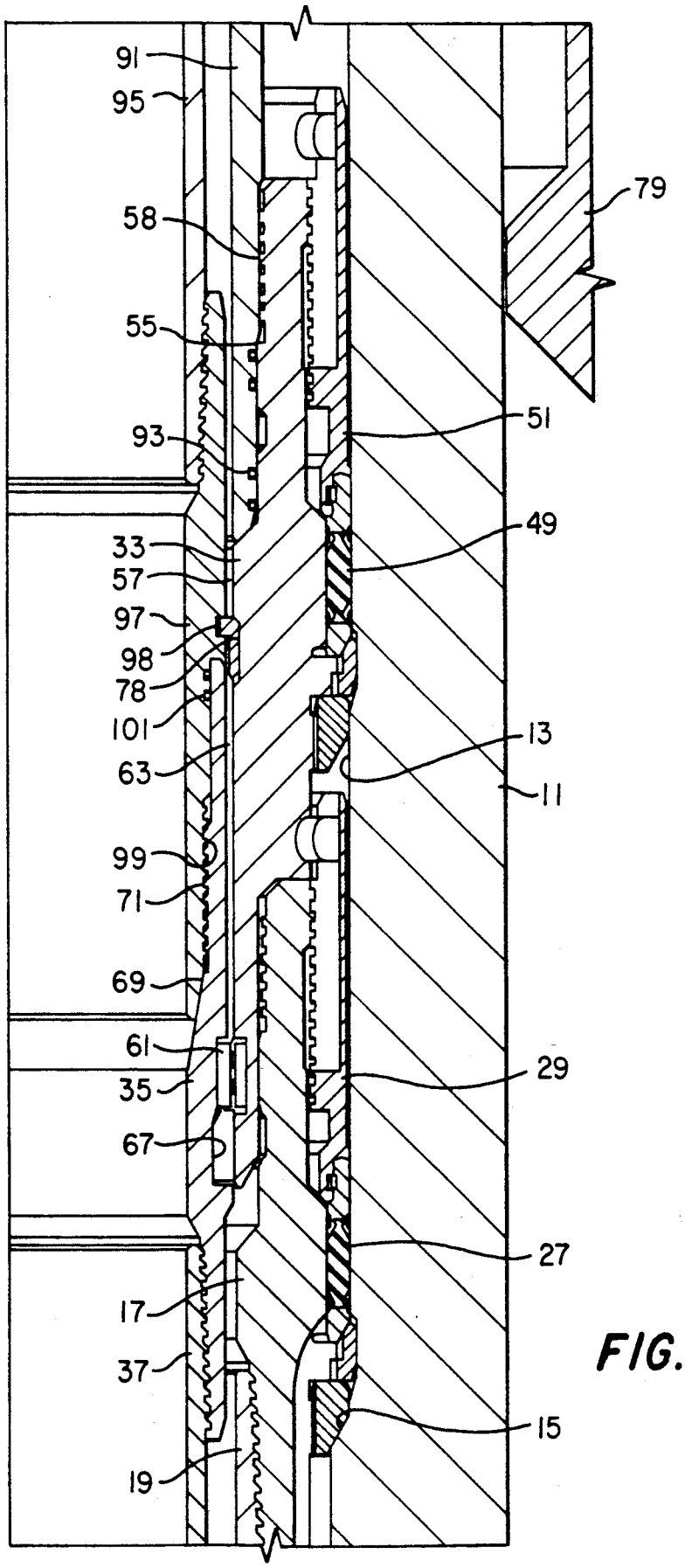

An intermediate string tieback conduit 87 will be lowered through the outer tieback conduit and latched into place for connecting with the intermediate string of casing 19 (FIG. 2B). The intermediate string 87 of tieback conduit comprises casing of the same diameter as intermediate string casing 19. A latch 89 is carried by the intermediate tieback string lower termination member 91. Latch 89 will engage threads formed in the torque nut 81. Latch 89 is a split ring that will ratchet into place during the landing procedure. If the intermediate tieback conduit 27 is later removed, rotation may be employed to release latch 89 from the torque nut 81.

The lower termination member 91 of the intermediate tieback conduit 87 slides into and ends in the upper bore section 55 of the outer hanger portion 33 (FIG. 2B). Seals 93 seal the intermediate tieback lower termination member 91 to the outer hanger portion 33.

After removal of protective sleeve 73, a string of inner tieback conduit 95 is lowered from the platform through the intermediate tieback conduit 87. Inner tieback conduit 95 comprises sections of casing of the same size as the inner casing 37. Inner tieback conduit 95 has a lower termination member 97. The lower termination member 97 has threads 99 on its exterior. Threads 99 will secure into the threads 71 in the inner hanger portion 35.

Figure 3:
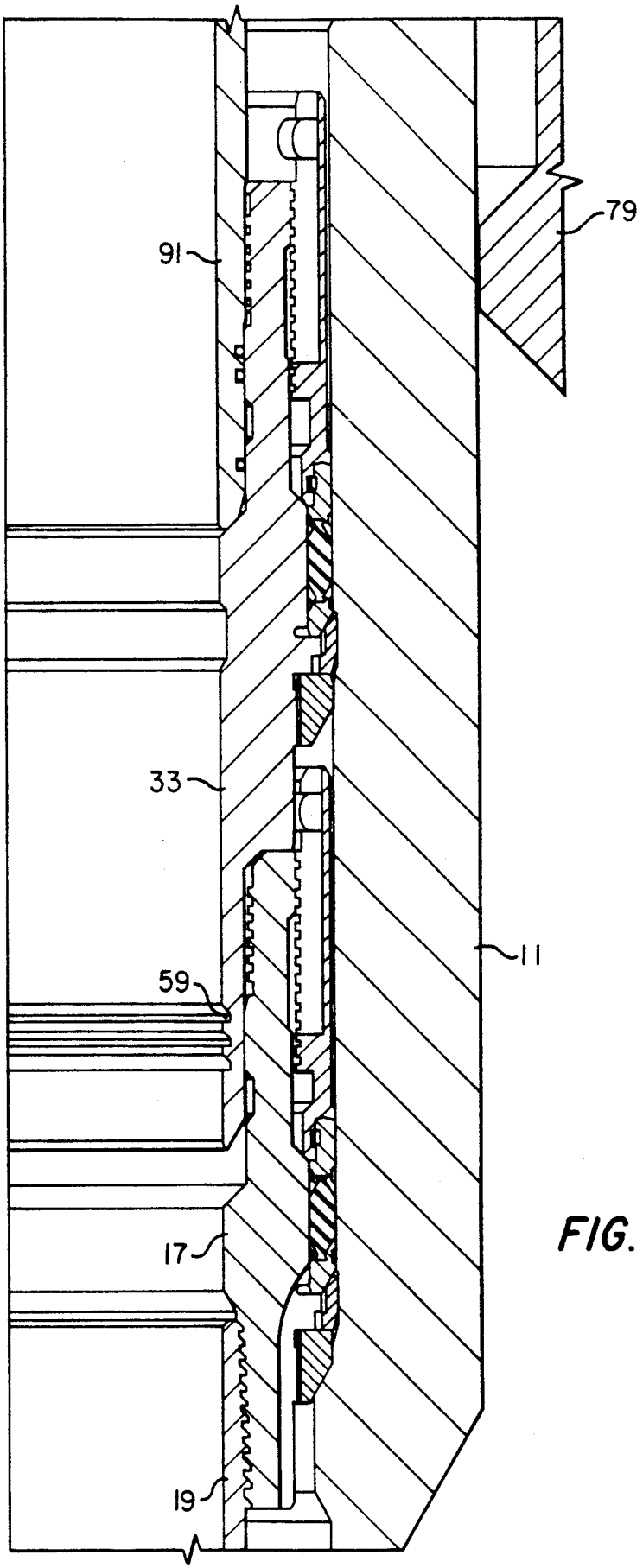
FIG. 3 is a vertical sectional view of a portion of the subsea wellhead as shown in FIGS. 2A and 2B, showing the tieback assembly and inner hanger portion removed in preparation for sidetrack drilling.

An annular lock member 98 will be carried by the lower termination member 97. Lock member 98 is a split ring of the same size and type as the lock member 77 (FIG. 1) that is carried by the protective sleeve 73. Lock member 98 snaps into the groove 78 previously occupied by the lock member 77. Once snapped in, lock member 98 will lock the lower termination member 97 to the outer hanger portion 33. A mating groove and shoulder on the lower termination 97 will pull the lock member 98 from groove 78 when later pulling upward on the lower termination member 97, as shown in FIG. 3.

Seals 101 seal the inner tieback conduit lower termination member 97 to the inner hanger portion 35. Once equipped as shown in FIGS. 2A and 2B, production tubing and other equipment may then be installed for producing the well.

In operation, the well will first be drilled through the wellhead housing 11 and conductor pipe (not shown) to a selected depth. Then intermediate casing 19 will be run on the intermediate casing hanger 17. The intermediate casing 19 will be cemented in place and a seal 27 installed.

Then, the well will be drilled to a greater depth. Once the desired depth has been reached, the inner casing string 37 will be run. In running the inner string 37, the outer hanger portion 33 and the inner hanger portion 35 will be latched together by latch ring 61. The protective sleeve 73 will be installed in place. The lock ring 77 will be wedged into the groove 78 by the protective sleeve 73. The inner string 37 will be secured to the lower end of the inner hanger portion 35. A running tool (not shown) will be secured to threads 58 of the outer hanger portion 33. The entire assembly will be lowered into the well.

The outer hanger portion 33 will land on the intermediate casing hanger 17. Cement will be pumped down the inner string 37 to return up the annulus between the inner string 37 and intermediate string 19. Once cemented, the seal 49 will be set between the outer hanger portion 33 and the bore 13 of wellhead housing 11.

Once a production platform has been positioned over wellhead housing 11, a tieback assembly will then be installed as illustrated in FIGS. 2A and 2B. The funnel 79 will be lowered on tieback conduit (not shown) over the wellhead housing 11. The intermediate tieback conduit 87 will be lowered in place and latched by latch 89. The protective sleeve 73 will be removed by a running tool engaging J-slots 74. The lock ring 77 will be retrieved along with the protective sleeve. The inner tieback conduit 95 will be lowered into place and rotated to secure it to threads 99, as shown in FIG. 2B. The lock member 98 will lock the lower termination 97 to the inner hanger portion 35. Conventional surface wellhead equipment (not shown) is progressively installed during this operation.

If it is later desired to sidetrack from the well, the operator will make a determination in a conventional manner as to the upper level of the cement. Having removed the Christmas tree and installed a blowout preventer, he will then remove the tubing. He will then lower a casing cutter to a point just above the upper level of the cement. He will cut the inner casing 37 at this point. The operator will then remove the cutting tool and plug the well at this point.

He will remove the inner string 37 of casing by pulling upward on the inner tieback conduit 95. The upward pull will move the inner hanger portion 35 upward relative to the outer hanger portion 33. Once the recess 67 positions radially inward of latch ring 61, the latch ring 61 will contract into recess 67. The latch ring 61 will no longer engage the grooves 65. Continued upward pulling will pull the inner hanger portion 35 and inner string 37 from the well.

Because the outer diameter of the inner portion 35 is less than the intermediate tieback conduit 87, there is no need to remove the intermediate tieback conduit 87 during this procedure. Once removed, the assembly will appear as shown in FIG. 3. The operator will then lower a drill bit on drill pipe (not shown) along with sidetracking equipment to drill a new inclined well from a point just above the cement level of the old well.

The invention has significant advantages. The two piece casing hanger allows the inner casing to be removed without removing the surface wellhead equipment or tieback conduit. This allows sidetracking without the need for stripping down the well permits operations with full pressure control.

While the invention has been shown in only one of its forms, it should be apparent to those skilled in the art that it is not so limited, but is susceptible to various changes without departing from the scope of the invention.

I claim:

1. In a subsea well having a wellhead housing having a bore, a casing hanger assembly comprising in combination:

an outer hanger portion which lands in wellhead housing, the outer hanger portion having a bore;

an inner hanger portion which has a lower end secured to a string of casing;

latch means for releasably latching the inner hanger portion to the outer hanger portion within the bore of the outer hanger portion;

engaging means on one of the hanger portions for engagement by a running tool to lower the inner and outer hanger portions into the wellhead housing while latched together by the latch means and with the string of casing secured to the inner hanger portion;

a seal located between the outer hanger portion and the bore of the wellhead housing for sealing the outer hanger portion to the wellhead housing after the outer hanger portion lands in the wellhead housing; and the latch means enabling the string of casing and the inner hanger portion to be subsequently retrieved to a drilling rig, while the outer hanger portion remains in the wellhead housing.

2. The subsea well according to claim 1 further comprising:

a tieback conduit that extends downward from the drilling rig and has a lower end that seals in the bore of the outer hanger portion above the inner hanger portion, the tieback conduit having a greater inner diameter than the inner hanger portion and string of casing, enabling the inner hanger portion and string of casing to be retrieved through the tieback conduit.

3. The subsea well according to claim 1 further comprising:

seal means located between the inner hanger portion and the outer hanger portion; and means for remotely removing the seal means from between the inner hanger portion and the outer hanger portion without removing the inner hanger portion from the outer hanger portion.

4. The subsea well according to claim 1 wherein the engaging means is located on the outer hanger portion.

5. The subsea well according to claim 1 wherein the latch means will release the inner hanger portion from the outer hanger portion in response to upward movement of the inner hanger portion relative to the outer hanger portion.

6. In a subsea well having a wellhead housing having a bore containing a landing shoulder, an intermediate string casing hanger supported on the landing shoulder and secured to a string of intermediate casing, a completion system for a string of inner casing located within the intermediate casing, comprising in combination:

an inner string casing hanger having an outer hanger portion which has an external downward facing shoulder that lands on the intermediate string casing hanger, the outer hanger portion having a bore with an upper section and a lower section of lesser diameter;

a seal located between the outer hanger portion and the bore of the wellhead housing;

the inner string casing hanger having an inner hanger portion which has a lower end secured to the string of inner casing and which has a bore;

latch means for latching the inner hanger portion to the outer hanger portion within the lower section of the bore of the outer hanger portion;

a tieback assembly extending downward from a drilling rig at the surface, having a lower end secured to the wellhead housing, the tieback assembly having an intermediate tieback conduit that extends into and seals in the upper section of the bore of the outer hanger portion and an inner tieback conduit that extends into and seals in the bore of the inner hanger portion; and the latch means having means for releasing the inner hanger portion from the outer hanger portion, enabling the string of inner casing, inner hanger portion and inner tieback conduit to be retrieved through the intermediate tieback conduit to the drilling rig, while the outer hanger portion remains in the wellhead housing.

7. The subsea well according to claim 6 further comprising:

seal means located between the inner hanger portion and the outer hanger portion for use during drilling of the well prior to installation of the tieback assembly; and means for remotely removing the seal means from between the inner hanger portion and the outer hanger portion prior to installation of the tieback assembly without removing the inner hanger portion from the outer hanger portion.

8. The subsea well according to claim 6 wherein the inner tieback conduit secures to the inner hanger portion, so that upward movement of the inner tieback conduit will also move the inner hanger portion and string of inner casing upward.

9. The subsea well according to claim 6 wherein the latch means allows the outer hanger portion and the inner hanger portion, along with the string of inner casing, to be lowered from the drilling rig simultaneously.

10. The subsea well according to claim 6 further comprising engagement means on the outer hanger portion for engagement by a running tool, for lowering the inner and outer portions into the wellhead housing while latched together and with the string of inner casing connected to the inner hanger portion.

11. The subsea well according to claim 6 wherein the latch means comprises:

an internal groove formed in the lower section of the bore of the outer hanger portion;

an external groove formed on the exterior of the inner hanger portion in a position for alignment with the internal groove;

a split ring which locates in the grooves when aligned to hold the inner and outer hanger portions together; and means for radially deflecting the split ring to cause the split ring to disengage from one of the grooves to allow the inner hanger portion to be removed from the outer hanger portion.

12. In a subsea well having a wellhead housing having a bore containing a landing shoulder, an intermediate string casing hanger supported on the landing shoulder and secured to a string of intermediate casing, a completion system for a string of inner casing located within the intermediate casing, comprising in combination:

an inner string casing hanger having an outer hanger portion which has an external downward facing shoulder that lands on the intermediate string casing hanger, the outer hanger portion having a bore with an upper section and a lower section of lesser diameter;

the inner string casing hanger having an inner hanger portion which has a lower end secured to the string of inner casing and which has a bore;

latch means for latching the inner hanger portion to the outer hanger portion within the lower section of the bore of the outer hanger portion;

means on the outer hanger portion for engagement by a running tool for lowering the inner and outer hanger portions into the wellhead housing while latched together and with the string of inner casing secured to the inner hanger portion;

a seal installed between the outer hanger portion and the bore of the wellhead housing after the outer hanger portion lands on the intermediate string casing hanger;

an intermediate tieback conduit that extends downward from a drilling rig into and seals in the upper section of the bore of the outer hanger portion after the outer hanger portion has landed on the intermediate string casing hanger;

an inner tieback conduit that extends downward from the drilling rig and secures to and seals in the bore of the inner hanger portion after the intermediate tieback conduit is installed;

seal means located between the inner hanger portion and the outer hanger portion for use during drilling of the well prior to installation of the tieback assembly;

means for remotely removing the seal means from between the inner hanger portion and the outer hanger portion prior to installation of the tieback assembly without removing the inner hanger portion from the outer hanger portion; and the latch means having means for releasing the inner hanger portion from the outer hanger portion by movement of the inner tieback conduit relative to the outer hanger portion, enabling the string of inner casing, inner hanger portion and inner tieback conduit to be retrieved through the intermediate tieback conduit to the drilling rig, while the outer hanger portion remains in the wellhead housing.

13. The subsea well according to claim 12 wherein the latch means comprises:

an internal groove formed in the lower section of the bore of the outer hanger portion;

an external groove formed on the exterior of the inner hanger portion in a position for alignment with the internal groove;

a split ring which locates in the grooves when aligned to hold the inner and outer hanger portions together; and means for radially deflecting the split ring to cause the split ring to disengage from one of the grooves to allow the inner hanger portion to be removed from the outer hanger portion.

14. The subsea well according to claim 13 wherein the means for radially deflecting the split ring comprises an annular recess located below and joining the external groove, the recess being of lesser diameter than the external groove, so that moving the inner housing portion upward relative to the split ring allows the split ring to radially retract into the recess, releasing the split ring from the external groove.

15. The subsea well according to claim 12 further comprising:

locking means for releasably locking the inner hanger portion to the outer hanger portion against upward movement of the inner hanger portion relative to the outer hanger portion when the inner tieback conduit is installed in the inner hanger portion.

16. A method of installing and removing a string of casing from a subsea wellhead housing, comprising:

providing a casing hanger with an outer hanger portion and an inner hanger portion;

securing the string of casing to the inner hanger portion;

releasably latching the inner hanger portion within the outer hanger portion;

lowering the inner and outer hanger portion into the wellhead housing with the string of casing secured to the inner hanger portion, and landing the outer hanger portion in the wellhead housing;

cementing the string of casing in the well;

setting a seal between the outer hanger portion and the wellhead housing after the outer hanger portion lands in the wellhead housing; then, to remove the string of casing, cutting the string of casing at a selected distance below the wellhead housing; then releasing the inner hanger portion from the outer hanger portion; then retrieving the inner hanger portion and the string of casing, while the outer hanger portion and seal remain in the wellhead housing.

17. The method according to claim 16 further comprising sealing between the inner hanger portion and the outer hanger portion.

18. The method according to claim 16 wherein the inner hanger portion and the outer hanger portions are lowered simultaneously into the well while latched together.

19. A method of installing in and removing a string of inner casing from a subsea wellhead housing which contains an intermediate string casing hanger supporting an intermediate string of casing, the method comprising:

providing an inner string casing hanger with an outer hanger portion and an inner hanger portion;

releasably latching the inner hanger portion within the outer hanger portion;

securing the string of inner casing to the inner hanger portion;

lowering the inner and outer hanger portions while latched together into the wellhead housing and with the string of inner casing secured to the inner hanger portion, and landing the outer hanger portion on the intermediate string casing hanger;

setting a seal between the outer hanger portion and the wellhead housing after the outer hanger portion lands in the wellhead housing;

cementing the string of inner casing in the well;

lowering an intermediate string tieback conduit into engagement with the outer hanger portion above the inner hanger portion;

lowering an inner string tieback conduit through the intermediate string tieback conduit into engagement with the inner hanger portion; then, to remove the string of inner casing, cutting the string of inner casing at a selected distance below the wellhead housing; then releasing the inner hanger portion from the outer hanger portion; then retrieving the inner hanger portion and the string of inner casing through the intermediate string tieback conduit by withdrawing the inner string tieback conduit, while the outer hanger portion and seal remain in the wellhead housing.

20. The method according to claim 19, further comprising:

installing a protective sleeve within the inner hanger portion prior to lowering the inner and outer hanger portions into the wellhead housing; then removing the protective sleeve from the inner hanger portion prior to installing the inner string tieback conduit.

21. A method of installing in and removing a string of inner casing from a subsea wellhead housing which contains an intermediate string casing hanger supporting an intermediate string of casing, the method comprising:

providing an inner string casing hanger with an outer hanger portion and an inner hanger portion;

securing the string of inner casing to the inner hanger portion;

releasably latching the inner hanger portion within the outer hanger portion;

lowering the inner hanger portion and outer hanger portion into the wellhead housing with the string of inner casing secured to the inner hanger portion, and landing the outer hanger portion on the intermediate string casing hanger;

setting a seal between the outer hanger portion and the wellhead housing after the outer hanger portion lands in the wellhead housing;

setting a seal between the inner hanger portion and the outer hanger portion;

cementing the string of inner casing in the well;

lowering an intermediate string tieback conduit into engagement with the outer hanger portion above the inner hanger portion;

removing the seal between the inner hanger portion and the outer hanger portion; then lowering an inner string tieback conduit through the intermediate string tieback conduit into engagement with the inner hanger portion;

locking the inner string tieback conduit to the outer hanger portion to prevent upward movement of the inner hanger portion to the outer hanger portion; then, to remove the string of inner casing.

cutting the string of inner casing at a selected distance below the wellhead housing; then releasing the inner hanger portion from the outer hanger portion and releasing the inner string tieback conduit from the outer hanger portion; then retrieving the inner hanger portion and the string of inner casing through the intermediate string tieback conduit by withdrawing the inner string tieback conduit, while the outer hanger portion and seal remain in the wellhead housing.

* * * * *